US010220431B2

(12) United States Patent
Mitsukawa et al.

(10) Patent No.: US 10,220,431 B2
(45) Date of Patent: Mar. 5, 2019

(54) OFFSET FIN MANUFACTURING METHOD AND OFFSET FIN MANUFACTURING APPARATUS

(71) Applicant: DENSO CORPORATION, Kariya, Aichi-pref. (JP)

(72) Inventors: Kazuhiro Mitsukawa, Kariya (JP); Masafumi Torimoto, Kariya (JP); Shinya Nii, Kariya (JP); Takao Ikeda, Kariya (JP); Kenta Nonoyama, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 307 days.

(21) Appl. No.: 15/043,674

(22) Filed: Feb. 15, 2016

(65) Prior Publication Data

US 2016/0236262 A1 Aug. 18, 2016

(30) Foreign Application Priority Data

Feb. 17, 2015 (JP) ..... 2015-28745

(51) Int. Cl.

| | |
|---|---|
| ***B21D 53/22*** | (2006.01) |
| ***B21D 53/02*** | (2006.01) |
| ***B21D 13/08*** | (2006.01) |
| ***B21D 13/10*** | (2006.01) |

(52) U.S. Cl.

CPC ..... *B21D 53/022* (2013.01); *B21D 13/08* (2013.01); *B21D 13/10* (2013.01)

(58) Field of Classification Search

CPC ..... B21D 53/022; B21D 13/10; B21D 13/08

See application file for complete search history.

(56) References Cited

U.S. PATENT DOCUMENTS 5,107,922 A * 4/1992 So ..... F28F 1/105 165/109.1
5,625,229 A * 4/1997 Kojima ..... F28F 3/025 257/712

(Continued)

FOREIGN PATENT DOCUMENTS

JP 2013-146736 A 8/2013
JP 2013-197187 A 9/2013

*Primary Examiner* — Ryan J. Walters
*Assistant Examiner* — Lawrence Averick
(74) *Attorney, Agent, or Firm* — Harness, Dickey & Pierce, P.L.C.

(57) ABSTRACT

An offset fin manufacturing method for manufacturing offset fins includes a feeding step of feeding a strip plate, a connection forming step of forming a connection in the strip plate, and an offset fin forming step of bending a planar plate portion located between corresponding two of the connections. In the offset fin forming step, each offset fin is formed such that two of top surface portions, which are located at an upstream end and a downstream end, respectively, of the offset fin in a feed direction of the strip plate, are respectively and directly connected to corresponding two of the connections. One of two of lateral surface portions joined to a corresponding one of the two of the top surface portions is not offset, and thereby a length of the corresponding one of the two of the top surface portions measured along a wave continuation direction is increased.

5 Claims, 10 Drawing Sheets

(56) References Cited

U.S. PATENT DOCUMENTS

RE35,890 E * 9/1998 So ..... F28F 1/105 165/109.1
6,415,855 B2 * 7/2002 Gerard ..... F25J 5/002 165/166
6,675,878 B2 * 1/2004 Haasch ..... F28D 9/0012 165/109.1
7,686,070 B2 * 3/2010 Chu ..... F28D 1/0316 165/109.1
8,151,617 B2 * 4/2012 Feng ..... B21D 53/04 165/109.1
8,418,752 B2 * 4/2013 Otahal ..... B21D 53/02 165/109.1
2002/0011331 A1 * 1/2002 Lehman ..... F25J 5/002 165/166
2002/0074109 A1 * 6/2002 Rhodes ..... F28D 1/05366 165/109.1
2002/0162646 A1 * 11/2002 Haasch ..... F28D 9/0012 165/109.1
2003/0066635 A1 * 4/2003 Rhodes ..... F28D 1/05366 165/148
2003/0187539 A1 * 10/2003 Smith ..... B21D 31/043 700/145
2005/0016240 A1 * 1/2005 Zurawel ..... B21D 13/045 72/177
2006/0231244 A1 * 10/2006 Sekine ..... B23K 3/087 165/173
2007/0163768 A1 * 7/2007 Shinhama ..... F28D 1/0391 165/183
2008/0011464 A1 * 1/2008 Oofune ..... F28D 7/1684 165/157
2011/0189525 A1 * 8/2011 Palanchon ..... H01M 10/615 429/120
2012/0144891 A1 6/2012 Feng et al.
2012/0222293 A1 * 9/2012 Ueda ..... B21D 53/022 29/727
2013/0180698 A1 * 7/2013 Mitsukawa ..... B21D 13/00 165/185
2013/0241068 A1 * 9/2013 Tanaka ..... H01L 21/02697 257/761

* cited by examiner

OFFSET FIN MANUFACTURING METHOD AND OFFSET FIN MANUFACTURING APPARATUS

CROSS REFERENCE TO RELATED APPLICATION

This application is based on and incorporates herein by reference Japanese Patent Application No. 2015-28745 filed on Feb. 17, 2015.

TECHNICAL FIELD

The present disclosure relates to an offset fin manufacturing method and an offset fin manufacturing apparatus.

BACKGROUND

Previously, there is known an offset fin manufacturing method that involves pressing of a plurality of punches against a strip plate, which is unwound and is fed from a roll of the strip plate, to form offset fins, each which has a cross section in a rectangular waveform and includes lateral surface portions that are alternately offset, JP2013-146736A (corresponding to US2013/0180698A1) discloses the offset fin manufacturing method of the above-described type. According to this method, a connection is formed in a strip plate at every predetermined interval in a feed direction of the strip plate, and a planar plate portion, which is located between corresponding two of the connections, is bent to produce an offset fin. Thereby, the offset fins, which are connected one after another by the connections, are continuously formed. Then, each corresponding one of the connections is cut at every predetermined number of the offset fins, to provide the predetermined number of the offset fins, which are connected one after another.

Lately, fin pitches of the offset fins have been progressively reduced to meet a demand of improving a heat exchange performance of the offset fins, and thereby a width of the connection, which connects between the offset fines, is also reduced. Because of this reason, at the time of transporting the offset fins, which are connected one after another by the connections, from, for example, a manufacturing factory to an assembling factory, there is a possibility of that the connections are broken and cut due to the insufficient strength of the connections. Thus, there is a difficulty of transporting the offset fins, which are connected one after another by the connections.

SUMMARY

The present disclosure addresses the above disadvantage.

According to the present disclosure, there is provided an offset fin manufacturing method for manufacturing offset fins, in each of which lateral surface portions and top surface portions are alternately and continuously formed to have a cross section in a rectangular waveform along a wave continuation direction of the rectangular waveform in each of rows, which are arranged one after another in a perpendicular direction that is perpendicular to the wave continuation direction, while each corresponding lateral surface portions among all of the lateral surface portions of the rows are alternately offset in the wave continuation direction at every predetermined length along the perpendicular direction, and thereby segments are formed by the lateral surface portions and the top surface portions of the rows in the offset fin. The offset fin manufacturing method includes a feeding step of feeding a strip plate; a connection forming step of forming a connection in the strip plate at every predetermined interval in a feed direction of the strip plate; and an offset fin forming step of bending a planar plate portion located between corresponding two of the connections in the strip plate to form each of the offset fins such that two of the top surface portions, which are located at an upstream end and a downstream end, respectively, of the offset fin in the feed direction of the strip plate, are respectively and directly connected to the corresponding two of the connections. The offset fin manufacturing method may additionally include a cutting step of cutting a corresponding one of the connections at every predetermined number of the offset fins, which are connected one after another by the connections. The offset fin forming step includes forming each of the offset fins such that two of the lateral surface portions are joined to a corresponding one of the two of the top surface portions, which are respectively and directly connected to the corresponding two of the connections, in a corresponding one of the rows, and one of the two of the lateral surface portions joined to the corresponding one of the two of the top surface portions is not offset in the wave continuation direction, and thereby a length of the corresponding one of the two of the top surface portions measured along the wave continuation direction is increased in comparison to at least another one of the top surface portions in the corresponding one of the rows. In the above offset fin manufacturing method, the perpendicular direction may be changed to any other crossing direction that crosses the wave continuation direction at an angle other than 90 degrees.

According to the present disclosure, there is also provided an offset fin manufacturing apparatus for manufacturing the offset fins described above. The offset fin manufacturing apparatus includes a feeding device, a connection forming device, and an offset fin forming device. The offset fin manufacturing apparatus may additionally include a cutting device described below. The feeding device feeds a strip plate. The connection forming device forms connections in the strip plate at every predetermined interval in a feed direction of the strip plate. The offset fin forming device bends a planar plate portion located between corresponding two of the connections in the strip plate to form each of the offset fins such that two of the top surface portions, which are located at an upstream end and a downstream end, respectively, of the offset fin in the feed direction of the strip plate, are respectively and directly connected to corresponding two of the connections. The cutting device cuts a corresponding one of the connections at every predetermined number of the offset fins, which are connected one after another by the connections. The offset fin forming device forms each of the offset fins such that two of the lateral surface portions are joined to a corresponding one of the two of the top surface portions, which are respectively and directly connected to the corresponding two of the connections, in a corresponding one of the rows, and one of the two of the lateral surface portions joined to the corresponding one of the two of the top surface portions is not offset in the wave continuation direction, and thereby a length of the corresponding one of the two of the top surface portions measured along the wave continuation direction is increased in comparison to at least another one of the top surface portions in the corresponding one of the rows. As discussed above with respect to the offset fin manufacturing method, the perpendicular direction may be changed to any other crossing direction that crosses the wave continuation direction at an angle other than 90 degrees.

BRIEF DESCRIPTION OF THE DRAWINGS

The drawings described herein are for illustration purposes only and are not intended to limit the scope of the present disclosure in any way.

DETAILED DESCRIPTION

Figure 1:
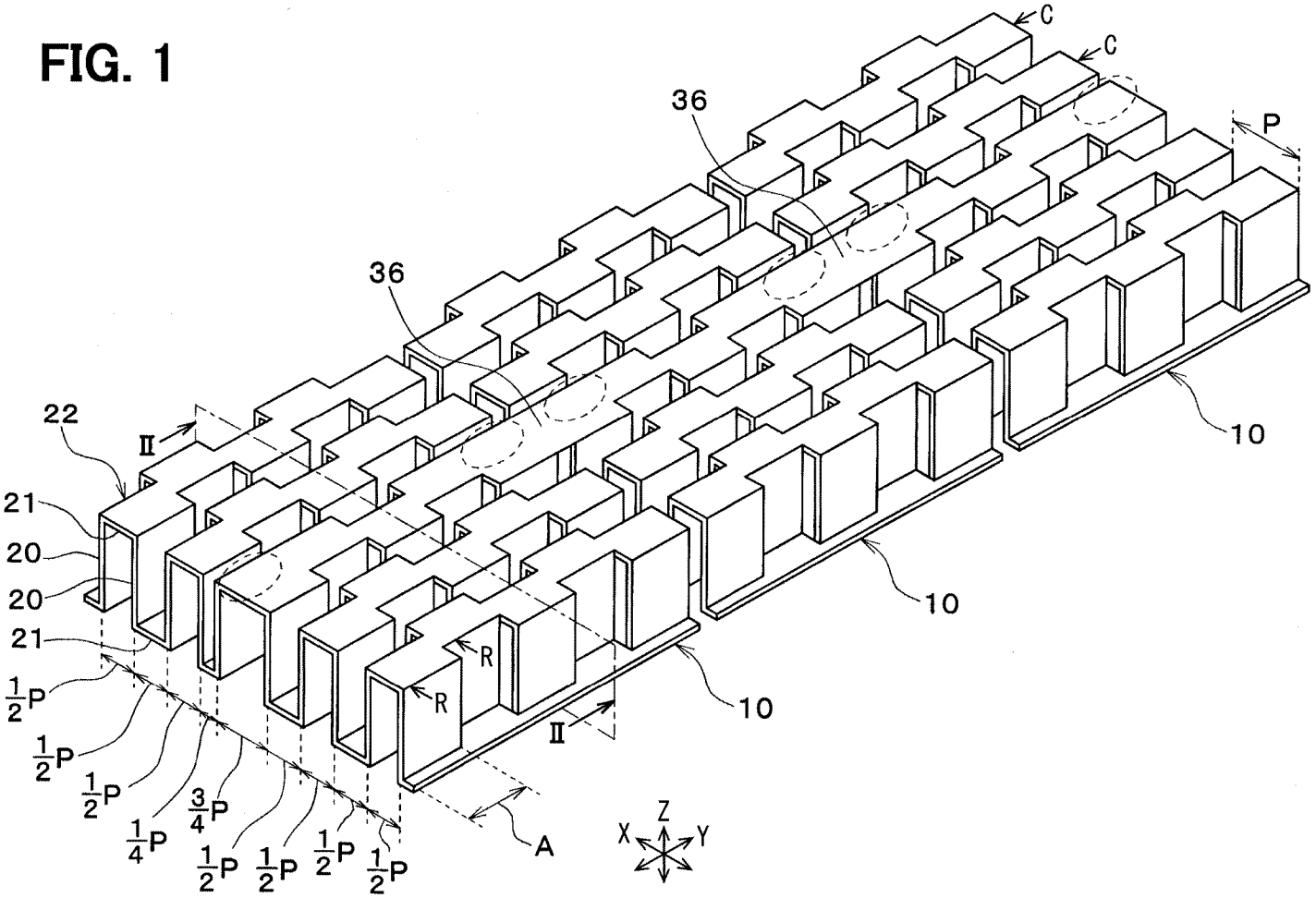
FIG. 1 is a perspective view showing offset fins according to a first embodiment of the present disclosure.

Various embodiments of the present disclosure will be described with reference to the accompanying drawings. In each of the following embodiments, the same or similar components are indicated by the same reference numerals in the drawing(s).

First Embodiment

A first embodiment of the present disclosure will be described with reference to FIGS. 1 to 6. An offset fin 10 of the present embodiment is used in an exhaust gas heat exchanger that exchanges heat between exhaust gas, which is generated through combustion of fuel at an internal combustion engine, and a cooling medium to cool the exhaust gas.

FIG. 1 shows, for illustrative purposes, three of the offset fins 10, which are connected one after another and are thereby not yet separated from each other. In each offset fin 10, a plurality of lateral surface portions 20 and a plurality of top surface portions 21 are alternately and continuously formed to have a cross section in a rectangular waveform along a wave continuation direction X (also referred to as a first direction or a direction along a first axis) of a rectangular waveform in each of a plurality of rows R, which are arranged one after another in a perpendicular direction Y (also referred to as a second direction or a direction along a second axis) that is perpendicular to the wave continuation direction X. Here, it should be noted that the wave continuation direction X is defined as a direction, along which a plurality of waves (a plurality of corrugations, more specifically a plurality of segments 22 described later) of the rectangular waveform is continuously formed one after another in each row R. The rows R may be referred to as rows of corrugations (or rows of segments 22). The perpendicular direction Y may be referred to as a crossing direction that crosses the wave continuation direction X. In the present embodiment, although this direction (crossing direction) Y crosses the wave continuation direction X at the angle of 90 degrees, this direction (crossing direction) Y may cross the wave continuation direction X at any angle other than 90 degrees. The top surface portions 21 include upper and lower top surface portions 21, which are respectively located at an upper side and a lower side along an orthogonal direction (also referred to as a third direction or a direction along a third axis) Z, which is orthogonal to the wave continuation direction X and the perpendicular direction Y, in FIG. 1. Each of the top surface portions 21 is a planar portion that is planar in a plane, which extends in the wave continuation direction X and the perpendicular direction Y. The lateral surface portions 20 include left and right lateral surface portions 20, which are respectively located at a left side and a right side of the corresponding top surface portion 21 along the wave continuation direction X in FIG. 1. Each of the lateral surface portions 20 is a planar portion that is planar in a plane, which extends in the perpendicular direction Y and the orthogonal direction Z.

In the offset fin 10, each adjacent two of the lateral surface portions 20, which are adjacent to each other in the perpendicular direction Y, are staggered (offset) relative to each other in the wave continuation direction X, and each adjacent two of the top surface portions 21, which are adjacent to each other in the perpendicular direction Y, are joined together and are staggered (offset) relative to each other in the wave continuation direction X. Furthermore, each adjacent two of the top surface portions 21, which are adjacent to each other in the wave continuation direction X, alternately project in two opposite directions (an upward direction and a downward direction in FIG. 1) along the orthogonal direction Z to respectively serve as the upper and lower top surface portions.

In the offset fin 10, with exceptions discussed later, basically, each corresponding lateral surface portions (a corresponding set of lateral surface portions) 20 among all of the lateral surface portions 20 of the rows R are alternately offset in the wave continuation direction X at every predetermined length along the perpendicular direction Y, and thereby the segments 22 are formed by the lateral surface portions 20 and the top surface portions 21 of the rows R. For instance, in FIG. 1, the right and lateral surface portions 20 of every rows R serve as the corresponding lateral surface portions (the corresponding set of lateral surface portions) 20, which are discussed above and are alternately offset in the wave continuation direction X at every predetermined length along the perpendicular direction Y. Also, the next lateral surface portions 20 of every rows R, which are located on the left side of the right end lateral surface portions 20 in the wave continuation direction X, serve as the next corresponding lateral surface portions (the next corresponding set of lateral surface portions) 20, which are alternately offset in the wave continuation direction X at every predetermined length along the perpendicular direction Y, and so on. Each of the segments 22 includes a corresponding one of the top surface portions 21 and corresponding two of the lateral surface portions 20, which are joined to and are located on the left side and the right side of the corresponding one of the top surface portions 21 in the wave continuation direction X. In the example of FIG. 1, each of the offset fins 10 includes five columns C (more specifically, five upwardly projecting ridges, which upwardly project in the orthogonal direction Z in FIG. 1) of the segments 22. In each of the five columns C of the segments 22, the top surface portions (more specifically, the upper top surface portions in FIG. 1) 21 are continuously arranged one after another in the perpendicular direction Y.

As shown in FIG. 1, the multiple offset fins (a plurality of offset fins) 10 are connected one after another by connections 36. In the example of FIG. 1, the three offset fins 10 are connected one after another by two connections 36.

A strip plate 30 (see FIG. 4) is processed such that the offset fins 10 are continuously manufactured in the connected state, in which the offset fins 10 are connected one after another by the connections 36. The number of the offset fins 10 to be connected one after another by the connections 36 may be freely set, and any desired number of the connected offset fins 10, which are connected one after another by the connections 36, may be obtained by cutting a corresponding one of the connections 36.

A corresponding one of the upper top surface portions 21, which is formed in one of each adjacent two of the offset fins 10 placed adjacent to each other in the perpendicular direction Y, is joined to, i.e., is directly connected to a corresponding one of the upper top surface portions 21, which is formed in the other one of each adjacent two of the offset fins 10, by the corresponding connection 36. In the present embodiment, each corresponding centered one of the upper top surface portions 21, which is centered in the wave continuation direction X in the offset fin 10 and is located at a corresponding end of the offset fin 10 in the perpendicular direction Y, is directly connected to the corresponding connection 36.

As described above, each corresponding lateral surface portions (corresponding set of lateral surface portions) 20 among all of the lateral surface portions 20 of the rows R are alternately offset in the wave continuation direction X at every predetermined length along the perpendicular direction Y. In the offset fin 10 of the present embodiment, the two lateral surface portions (the left and right lateral surface portions) 20, which are joined to the centered top surface portion 21 that is directly connected to the corresponding connection 36, includes an offsetting lateral surface portion 20, which is offset in the wave continuation direction X and has the predetermined length A in the perpendicular direction Y, and a non-offsetting lateral surface portion 20, which is not offset in the wave continuation direction X and has the predetermined length A in the perpendicular direction Y.

Specifically, in the offset fin 10 of the present embodiment, one (the left side lateral surface portion 20, which is located on the left side in the wave continuation direction X in FIG. 1) of the two lateral surface portions 20, which are joined to the centered top surface portion 21 that is directly connected to the corresponding connection 36, is not offset in the wave continuation direction X, and only the other one (the right side lateral surface portion 20, which is located on the right side in the wave continuation direction X in FIG. 1) is offset in the wave continuation direction X. The non-offsetting lateral surface portion 20 is flush with and is directly connected to the adjacent lateral surface portion 20, which is adjacent to the non-offsetting lateral surface portion 20 in the perpendicular direction Y. In FIG. 1, each portion, which is located in a dotted ellipse, indicates the corresponding non-offsetting lateral surface portion 20 among the two lateral surface portions 20, which are joined to the centered top surface portion 21 that is directly connected to the corresponding connection 36.

Here, it is assumed that a distance between two of the lateral surface portions 20, which are located on the same side (e.g. the left side) of the corresponding upper top surface portion 21 in the wave continuation direction X, is referred to as a fin pitch P. In such a case, a length of each top surface portion 21, which is measured in the wave continuation direction X, is basically P/2, i.e., one half of the pitch P. However, at the centered top surface portion 21, which is centered in the wave continuation direction X in the offset fin 10 and is directly connected to the corresponding connection 36, a length (hereinafter also referred to as a width) of the centered top surface portion 21 measured in the wave continuation direction X is increased by an amount that corresponds to the non-offsetting amount of the non-offsetting lateral surface portion 20 (the left side lateral surface portion 20, which is located on the left side in the wave continuation direction X in FIG. 1), so that the length of the centered top surface portion 21 measured in the wave continuation direction X is (3/4)P, i.e., three fourth of the pitch P.

When the one of the two lateral surface portions 20, which are joined to the centered top surface portion 21 directly connected to the corresponding connection 36, is not offset in the wave continuation direction X while the other one of the two lateral surface portions 20 is offset in the wave continuation direction X in the above described manner, the centered top surface portion 21, which is directly connected to the corresponding connection 36, becomes the widest top surface portion 21, which is wider in the wave continuation direction X in comparison to the other top surface portions 21 in the same row.

Furthermore, the non-offsetting lateral surface portion 20 is placed closer to the opposing lateral surface portion 20, which opposes the non-offsetting lateral surface portion 20 in the wave continuation direction X (i.e., the left side lateral surface portion 20, which is located on the left side of the non-offsetting lateral surface portion 20 along the wave continuation direction X in FIG. 1). Thus, on the side (the non-offsetting lateral surface portion 20 side) of the centered top surface portion 21 where the non-offsetting lateral surface portion 20 is placed, the adjacent lower top surface portion 21, which is located on the left side of the centered top surface portion 21 directly connected to the corresponding connection 36, has a length P/4, i.e., one fourth of the pitch P in the wave continuation direction X. Thereby, this adjacent lower top surface portion 21 is formed as a narrow top surface portion 21, which has the narrow width in the wave continuation direction X (the narrowest width in the row R).

Figure 2:
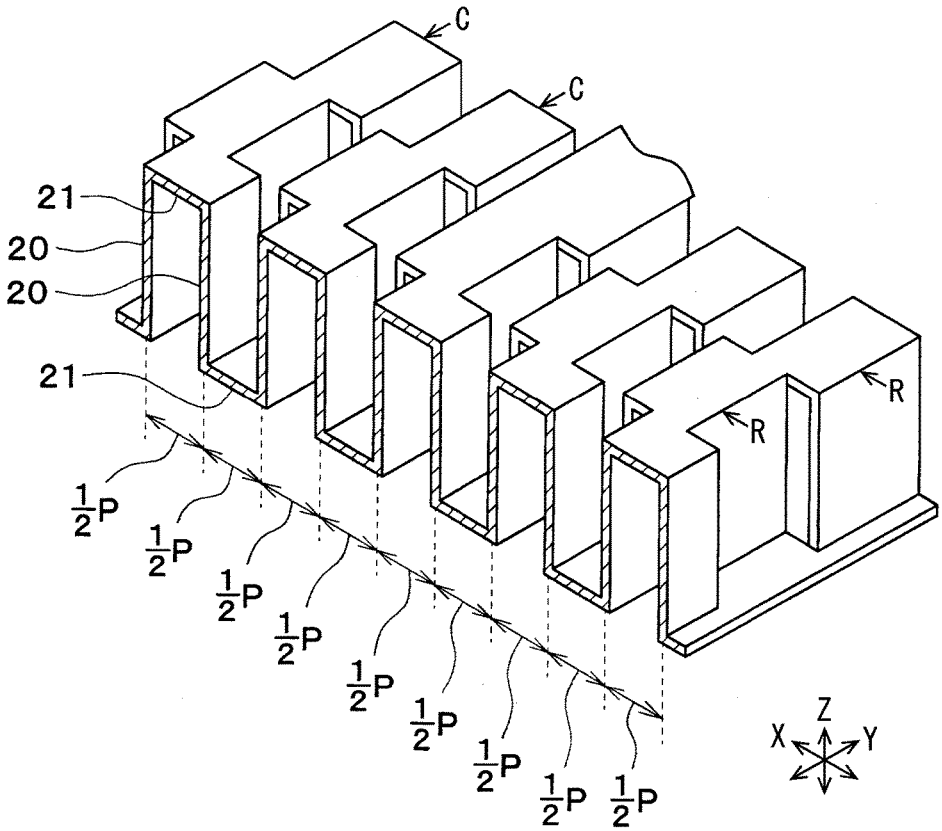
FIG. 2 is a cross sectional view taken along line II-II in FIG. 1.

Furthermore, as shown in FIG. 2, at a center part of the offset fin 10, which is centered in the perpendicular direction Y, all of the top surface portions 21, which are arranged one after another in the wave continuation direction X, have the identical length (width) P/2, i.e., one half of the pitch P in the wave continuation direction X. That is, in the offset fin 10, all of the top surface portions 21 have the width P/2 except each corresponding centered top surface portion 21, which is directly connected to the corresponding connection 36, and its adjacent narrow top surface portion 21.

Figure 3:
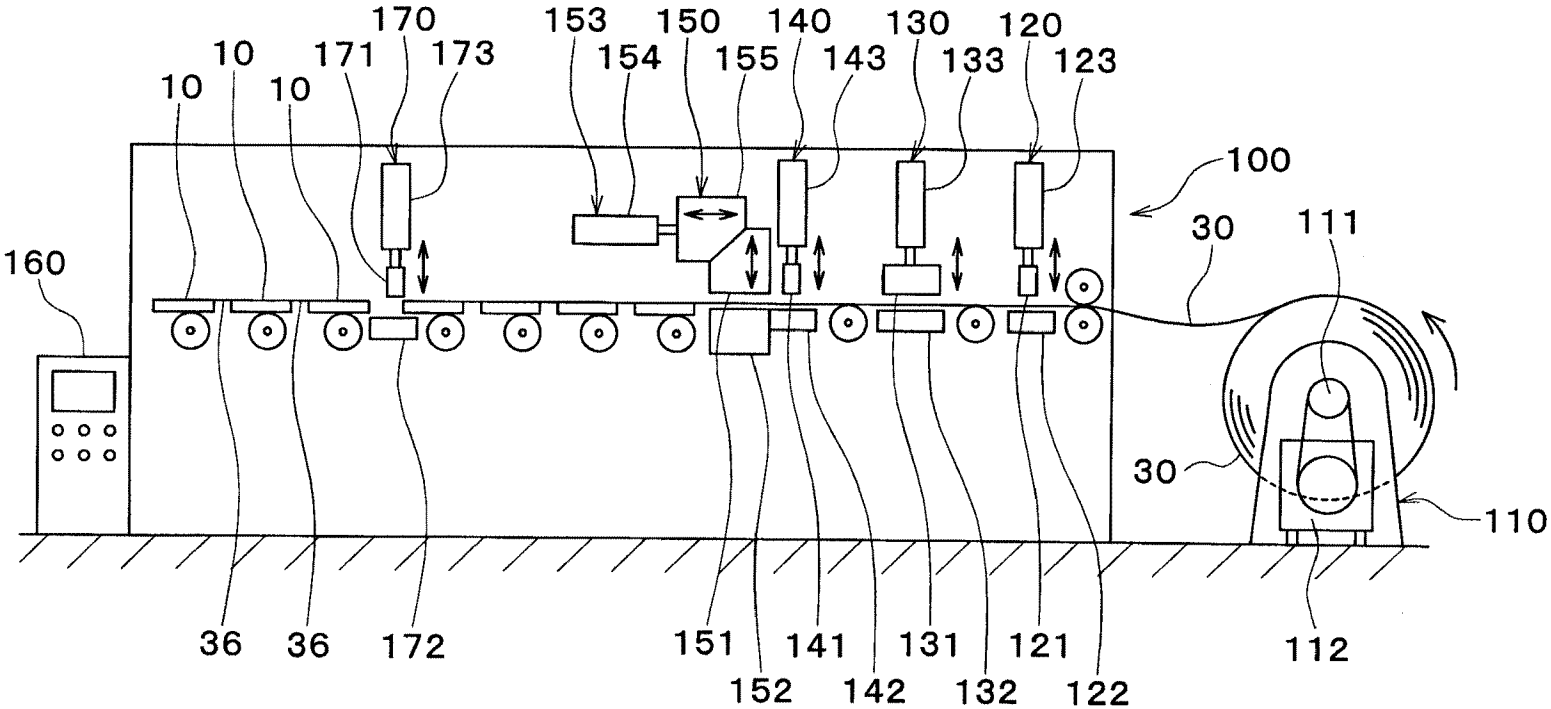
FIG. 3 is a schematic diagram indicating an offset fin manufacturing apparatus according to the first embodiment.
Figure 4:
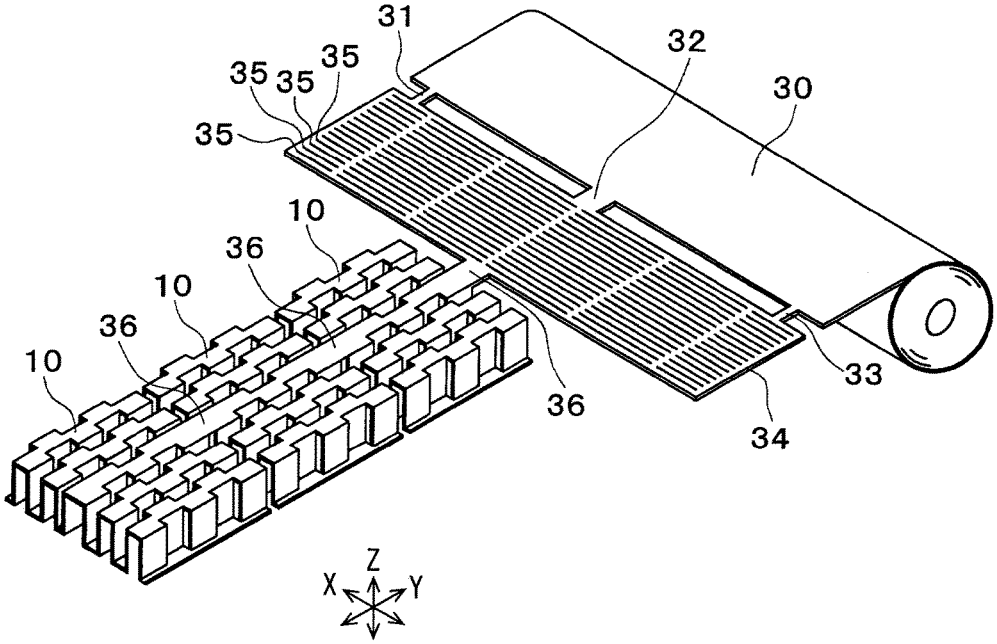
FIG. 4 is a perspective view showing a strip plate and the offset fin according to the first embodiment.

Next, an offset fin manufacturing apparatus will be described with reference to FIGS. 3 to 5. As shown in FIG. 3, the offset fin manufacturing apparatus 100 includes a feeding device (feeding means) 110, a connective portion forming device (connective portion forming means) 120, a slit forming device (slit forming means) 130, a connection forming device (connection forming means) 140, an offset fin forming device (offset fin forming means) 150, a setting device (setting means) 160 and a cutting device (cutting means) 170.

The feeding device 110 includes a rotatable shaft 111 and a rotational drive device 112. The rotatable shaft 111 holds a rolled strip plate 30, which is rolled into a coil form, and the rotatable shaft 111 is rotated integrally with the rolled strip plate 30. The strip plate 30 is a metal material, from which the offset fins 10 are formed. The rotational drive device 112 includes, for example, an electric motor. The rotational drive device 112 rotates the rotatable shaft 111 such that the rolled strip plate 30 is unrolled and is spread to feed the unrolled strip plate 30 in a longitudinal direction of the unrolled strip plate 30. A predetermined length (predetermined amount) of the strip plate 30 is intermittently fed. In FIG. 3, a feed direction of the strip plate 30 is a leftward direction, i.e., a direction from the right side toward the left side.

The connective portion forming device 120 is located on a downstream side of the feeding device 110 in the feed direction of the strip plate 30. The connective portion forming device 120 includes a connective portion forming punch 121, a connective portion forming die 122, and a connective portion forming punch drive device 123.

The connective portion forming punch 121 is placed on an upper side of the connective portion forming die 122 and is movable in a top-to-bottom direction. The connective portion forming punch drive device 123 includes, for example, a hydraulic cylinder or an electric cylinder. The connective portion forming punch drive device 123 downwardly and upwardly drives the connective portion forming punch 121 every time the predetermined length (predetermined amount) of the strip plate 30 is fed by the feeding device 110.

When the connective portion forming punch 121 is upwardly driven, the connective portion forming punch 121 is moved away from the strip plate 30. In contrast, when the connective portion forming punch 121 is downwardly driven, the strip plate 30 is clamped between the connective portion forming punch 121 and the connective portion forming die 122 and is punched (i.e., is cut) in a punching process. In the punching process with the connective portion forming punch 121, three connective portions, i.e., first to third connective portions 31, 32, 33 are formed at three locations, respectively, of the strip plate 30, which are arranged one after another in a width direction of the strip plate 30 (a transverse direction that is perpendicular to the longitudinal direction of the strip plate 30), at every predetermined interval on the strip plate 30 in the feed direction of the strip plate 30 (see FIG. 4).

The second connective portion 32 is formed at a widthwise center part of the strip plate 30, and the first and third connective portions 31, 33 are formed at two widthwise end parts, respectively, of the strip plate 30. The connective portions 31, 32, 33 connect between two adjacent planar plate portions 34, which are located on the forward side and the backward side in the feed direction, to stabilize the feeding of these planar plate portions 34.

The slit forming device 130 is placed on a downstream side of the connective portion forming device 120 in the feed direction of the strip plate 30. The slit forming device 130 includes a slit forming punch 131, a slit forming die 132 and a slit forming punch drive device 133.

The slit forming punch 131 is placed on an upper side of the slit forming die 132 and is movable in the top-to-bottom direction. The slit forming punch drive device 133 includes, for example, a hydraulic cylinder or an electric cylinder. The slit forming punch drive device 133 downwardly and upwardly drives the slit forming punch 131 every time the predetermined length (predetermined amount) of the strip plate 30 is fed by the feeding device 110.

When the slit forming punch 131 is upwardly driven, the slit forming punch 131 is moved away from the strip plate 30. In contrast, when the slit forming punch 131 is downwardly driven, the strip plate 30 is clamped between the slit forming punch 131 and the slit forming die 132 and is punched (i.e., is cut) to form a plurality of slits 35.

The connection forming device 140 is placed on a downstream side of the slit forming device 130 in the feed direction of the strip plate 30. The connection forming device 140 includes a cutting punch 141, a cutting die 142 and a cutting punch drive device 143. The cutting punch 141 is placed on an upper side of the cutting die 142 and is movable in the top-to-bottom direction. The cutting punch drive device 143 includes, for example, a hydraulic cylinder or an electric cylinder. The cutting punch drive device 143 downwardly and upwardly drives the cutting punch 141 every time the predetermined length (predetermined amount) of the strip plate 30 is fed by the feeding device 110.

When the cutting punch 141 is upwardly driven, the cutting punch 141 is moved away from the strip plate 30. In contrast, when the cutting punch 141 is downwardly driven, the strip plate 30 is clamped between the cutting punch 141 and the cutting die 142 and is punched to cut the first connective portion 31 and the third connective portion 33 while leaving the second connective portion 32 as the connection 36 (see FIG. 4). That is, the connection forming device 140 forms the connection 36 at the single location, which is centered in the width direction of the strip plate 30, at every predetermined interval in the feed direction of the strip plate 30.

The offset fin forming device 150 is placed on the downstream side of the connection forming device 140 in the feed direction of the strip plate 30. The offset fin forming device 150 bends the planar plate portion 34, in which the slits 35 are formed, in a bending process to form the offset fin 10. The offset fin forming device 150 includes a plurality of upper punches 151, a plurality of lower punches 152, and a punch drive device 153.

The upper punches 151 are placed on an upper side of the strip plate 30, and the lower punches 152 are placed on a lower side of the strip plate 30. The upper punches 151 and the lower punches 152 are provided to form the offset fin 10 by bending the planar plate portion 34 in the bending process.

The upper punches 151 are provided to correspond with the lower top surface portions 21, which project at the lower side of the offset fin 10. The lower punches 152 are provided to correspond with the upper top surface portion 21, which project at the upper side of the offset fin 10. The upper punches 151 are movable in the top-to-bottom direction. When the upper punches 151 are upwardly driven, the upper punches 151 are moved away from the strip plate 30. In contrast, when the upper punches 151 are downwardly driven, the strip plate 30 is clamped between the upper punches 151 and the lower punches 152 to bend the planar plate portion 34 in the bending process.

The punch drive device 153 includes a drive unit 154 and a cam unit 155. The drive unit 154 includes, for example, a hydraulic cylinder or an electric cylinder. The drive unit 154 urges the cam unit 155 against the upper punches 151. The punch drive device 153 urges the upper punches 151 against the planar plate portion 34 of the strip plate 30. In this way, the planar plate portion 34 is deformed in conformity with the shapes of the upper punches 151 and the shapes of the lower punches 152 to form the offset fin 10.

Now, the upper punches 151 and the lower punches 152 will be described with reference to FIG. 5. In FIG. 5, for descriptive purposes, only two of the upper punches 151 and only three of the lower punches 152, and a processing state of the planar plate portion 34, which is processed with these punches 151, 152, are depicted, and the depiction of the remaining punches 151, 152 is omitted for the sake of simplicity. Furthermore, the slits 35 formed in the planar plate portion 34 are omitted, and the other planar plate portions 34, which are located on the forward side and the backward side of the subject planar plate portion 34, are also omitted.

Figure 5:
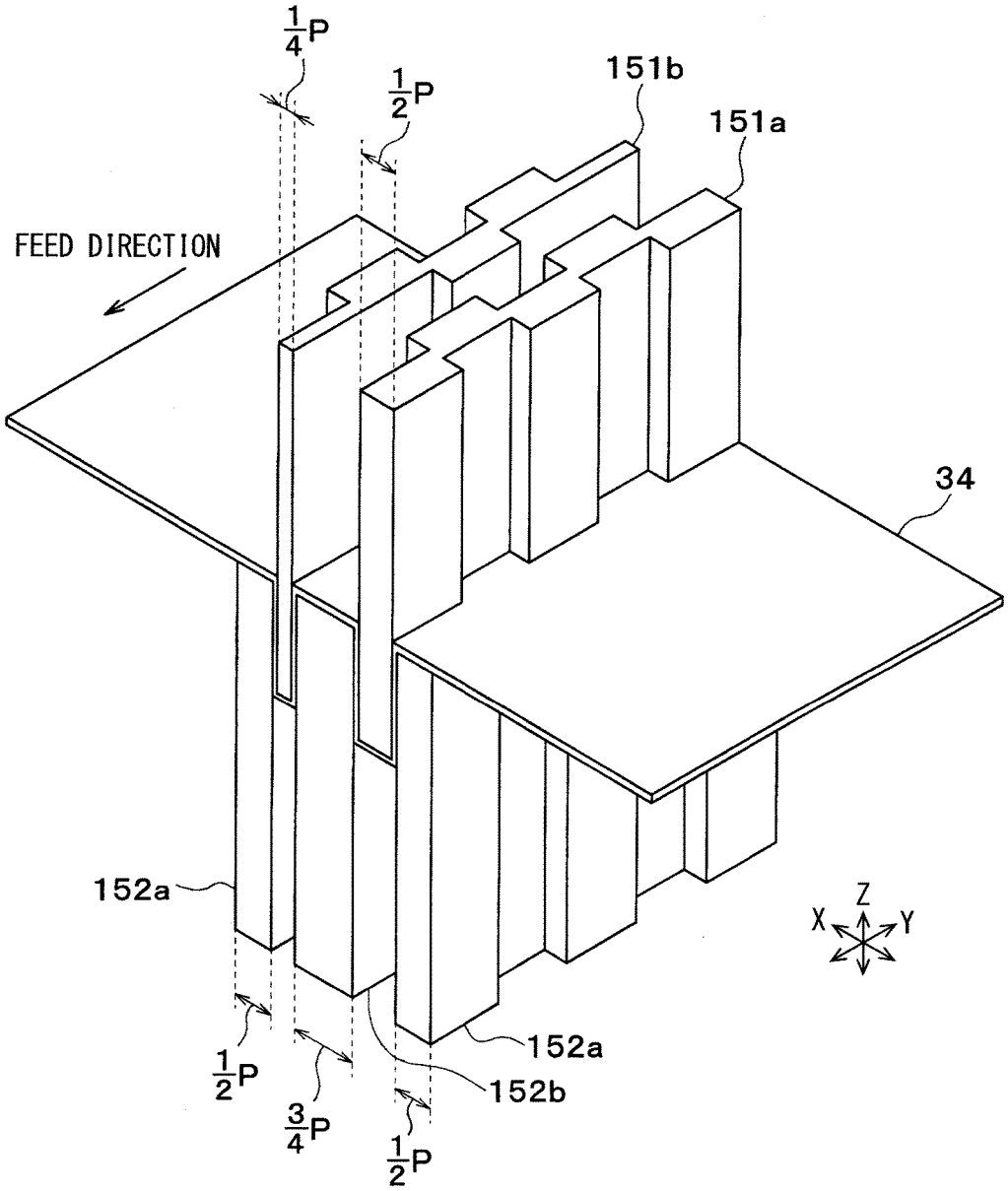
FIG. 5 is a perspective view showing punches of an offset in forming device according to the first embodiment.

As shown in FIG. 5, each of the upper punches 151 and the lower punches 152 has a corresponding cross section that is shaped to correspond with the shapes of the corresponding top surface portions 21.

The upper punches 151 of the present embodiment shown in FIG. 5 include a primary upper punch 151*a* and a secondary upper punch 151*b*. Every part of the primary upper punch (a punch having a normal width) 151*a* has a constant width, which is measured in the wave continuation direction X and is P/2 (i.e., one half of the pitch P). An upstream end part and a downstream end part of the secondary upper punch (a punch having a narrow width) 151*b*, which are respectively located on the upstream side and the downstream side in the feed direction (corresponding to the perpendicular direction Y) of the strip plate 30, has a narrow width, which is measured in the wave continuation direction X and is P/4 (i.e., one fourth of the pitch P). Similarly, the lower punches 152 of the present embodiment shown in FIG. 5 include primary lower punches 152*a* and a secondary lower punch 152*b*. Every part of each primary lower punch (a punch having a normal width) 152*a* has a constant width, which is measured in the wave continuation direction X and is P/2 (i.e., one half of the pich P). An upstream end part and a downstream and part of the secondary lower punch (a punch having a wide width) 152*b*, which are respectively located on the upstream side and the downstream side in the feed direction (corresponding to the perpendicular direction Y) of the strip plate 30, has a wide width, which is measured in the wave continuation direction X and is (3/4)P (i.e., three fourth of the pitch P). The secondary lower punch 152*b* shown in FIG. 5 is placed such that the widthwise location of the secondary lower punch 152*b* (i.e., the location of the secondary lower punch 152*b* in the wave continuation direction X) coincides with that of the connection 36.

When the upper punches 151 and the lower punches 152 discussed above are used, the centered top surface portion 21, which is directly connected to the corresponding connection 36, can have the width, which is measured in the wave continuation direction X and is increased in comparison to the width of the other top surface portions 21.

The setting device 160 includes an input unit and a setting unit. The input unit includes, for example, press buttons. The setting unit sets the number of the offset fins 10 to be connected one after another as a single unit (i.e., a unit to be transported from, for example, a manufacturing factory to an assembling factory) based on an electric signal received from the input unit. The number of the offset fins 10, which is set through the setting unit, is transmitted to the cutting device 170.

The cutting device 170 is placed on a downstream side of the offset fin forming device 150 in the feed direction. The cutting device 170 includes a cutting punch 171, a cutting die 172 and a cutting punch drive device 173.

The cutting punch 171 is placed on an upper side of the connection 36 of the strip plate 30. The cutting punch 171 is movable toward and away from the connection 36 of the strip plate 30 in the top-to-bottom direction. The cutting punch 171 includes a cutting blade (not shown), which can cut the connection 36 of the strip plate 30. The cutting die 172 is placed on a lower side of the strip plate 30 and includes a die hole (not shown), which corresponds to the cutting blade of the cutting punch 171.

The cutting punch drive device 173 includes, for example, a hydraulic cylinder or an electric cylinder. The feeding device 110 increments a count number every time the predetermined length (the predetermined amount) of the strip plate 30 is fed. When the count number coincides with a preset number of the offset fins 10 to be connected one after another as the single unit, the cutting punch drive device 173 downwardly and upwardly drives the cutting punch 171 to cut the corresponding connection 36 of the strip plate 30.

Next, the manufacturing method of the offset fins 10 using the offset fin manufacturing apparatus 100 having the above-described structure will be described with reference to FIG. 6.

Figure 6:
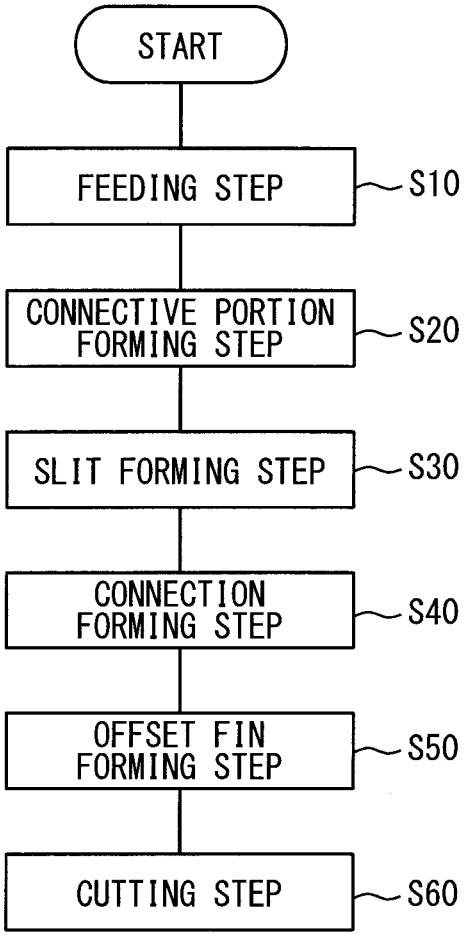
FIG. 6 is a flowchart indicating offset fin manufacturing steps according to the first embodiment.

As shown in FIG. 6, the manufacturing method of the offset fins 10 includes a feeding step S10, a connective portion forming step S20, a slit forming step S30, a connection forming step S40, an offset fin forming step S50 and a cutting step S60.

First of all, at the feeding step SW, the rotational drive device 112 is driven to rotate the rotatable shaft 111, around which the strip plate 30 is set and is rolled into the coil form. Thus, the rolled strip plate 30 is unwound and is fed in the longitudinal direction of the strip plate 30. The predetermined length (predetermined amount) of the strip plate 30 is intermittently fed by the feeding device 110.

Then, at the connective portion forming step S20, every time the predetermined length (predetermined amount) of the strip plate 30 is fed by the feeding device 110, the connective portion forming punch drive device 123 downwardly and upwardly drives the connective portion forming punch 121. Thus, the connective portions 31, 32, 33 are formed at the three locations, respectively, of the strip plate 30, which are arranged one after another in the width direction of the strip plate 30 (the transverse direction that is perpendicular to the longitudinal direction of the strip plate 30), at every predetermined interval on the strip plate 30 in the feed direction of the strip plate 30.

Then, at slit forming step S30, the slit forming punch drive device 133 downwardly and upwardly drives the slit forming punch 131 every time the predetermined length (predetermined amount) of the strip plate 30 is fed by the feeding device 110. Thereby, the slits 35 are formed in the planar plate portion 34 of the strip plate 30.

Next, at the connection forming step S40, the cutting punch drive device 143 downwardly and upwardly drives the cutting punch 141 every time the predetermined length (predetermined amount) of the strip plate 30 is fed by the feeding device 110. Thus, the first connective portion 31 and the third connective portion 33 are cut while the second connective portion 32 remains uncut. In this way, the connection 36 is formed at the single location, which is centered in the width direction of the strip plate 30, at every predetermined interval in the feed direction of the strip plate 30.

Thereafter, at the offset fin forming step S50, the drive unit 154 of the punch drive device 153 urges the cam unit 155 against the upper punches 151. Thereby, the upper punches 151 are urged against the planar plate portion 34. Thus, the planar plate portion 34 is bent to form the generally rectangular shaped waveform (corrugations, more specifically the segments 22), so that the lateral surface portions 20 and the top surface portions 21 are formed. At this time, the corresponding two top surface portions 21 of the offset fin 10 are respectively and directly connected to the corresponding connections 36 at the upstream side and the downstream side, respectively, in the feed direction of the strip plate 30.

Next, at the cutting step S60, the cutting punch drive device 173 downwardly and upwardly drives the cutting punch 171 at every predetermined number of the connected offset fins 10, which is set by the setting device 160. Thus, the connection 36 is cut every predetermined number of the connected offset fins 10. By executing the above-described steps, the offset fins 10, which are connected one after another by the connections 36 as the single unit, can be obtained.

According to the present embodiment discussed above, at the time of manufacturing the offset fins 10, which are connected by the connections 36, the one of the two lateral surface portions 20, which are joined to the top surface portion 21 directly connected to the corresponding connection 36, is not offset. In this way, the top surface portion 21, which is directly connected to the corresponding connection 36, can have the increased length, which is measured in the wave continuation direction X and is larger than that of the other top surface portions 21. As a result, the strength of the connection 36 can be increased. Thereby, it is possible to limit occurrence of cutting (breakage) of the connection(s) 36 at the time of transporting the multiple offset fins 10, which are connected one after another by the connections 36.

Furthermore, according to the present embodiment, at the center part of the offset fin 10, which is centered in the perpendicular direction Y all of the top surface portions 21, which are arranged one after another in the wave continuation direction X, have the identical length P/2, i.e., one half of the pitch P. In this way, the other top surface portions 21, which are other than the top surface portions 21 directly connected to the corresponding connections 36, respectively, can have the identical width, which is measured in the wave continuation direction X and is equal to each other in the offset fin 10. Thereby, it is possibly to minimize the deterioration in the heat exchange performance of the offset fin 10.

Second Embodiment

Next, a second embodiment of the present disclosure will be described with reference to FIGS. 7 and 8. In the second embodiment, similar portions, which are similar to those of the first embodiment, will not be described redundantly, and only different portions, which are different from the first embodiment, will be described.

Figure 7:
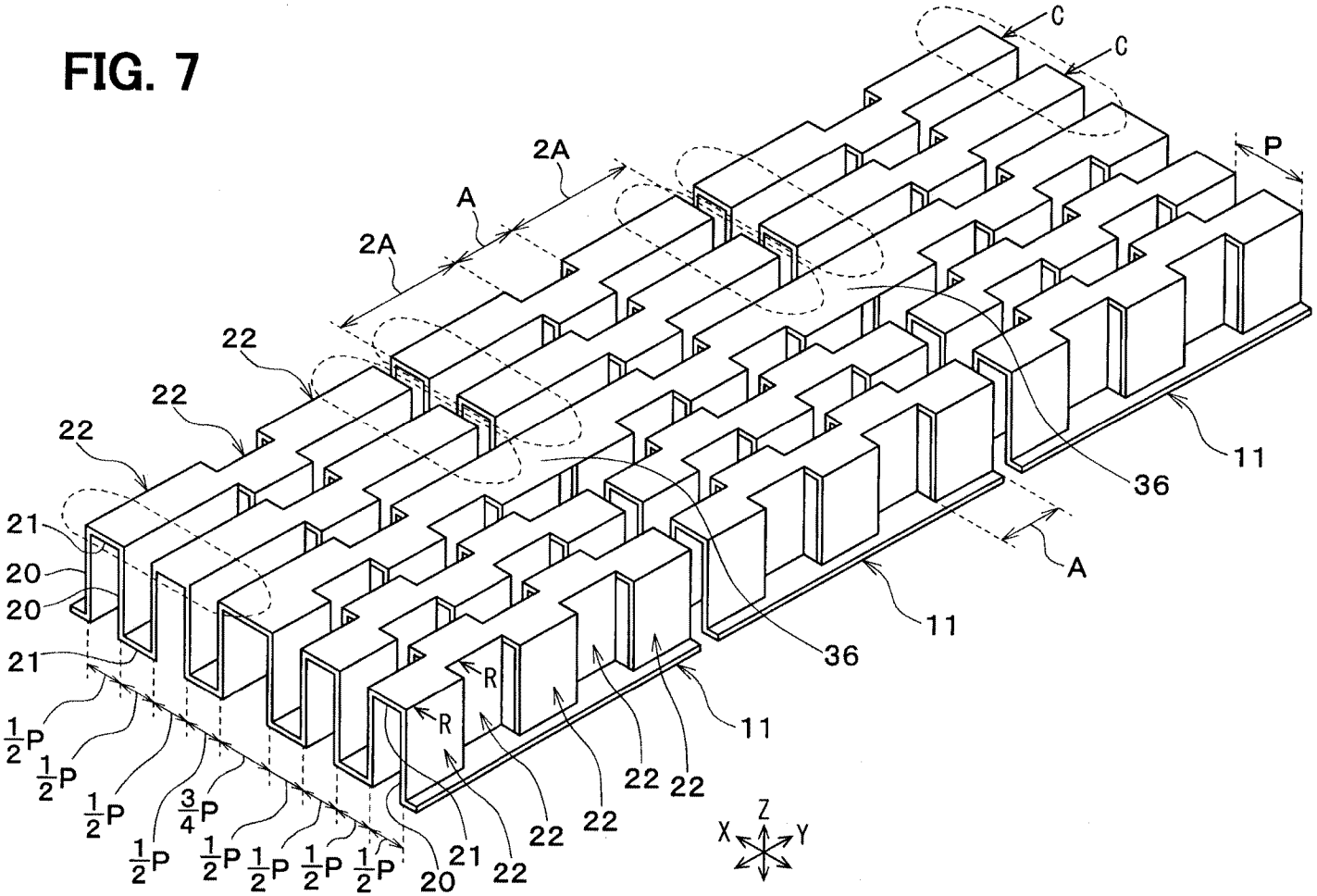
FIG. 7 is a perspective view showing offset fins according to a second embodiment of the present disclosure.

As shown in FIG. 7, in an offset fin 11 of the second embodiment, similar to the offset fin 10 of the first embodiment, one (left one in the wave continuation direction X in FIG. 7) of the two lateral surface portions 20, which are joined to the corresponding connection 36, is not offset.

Furthermore, in the offset fin 11 of the second embodiment, in addition to the non-offsetting lateral surface portion 20, which is joined to the top surface portion 21 directly connected to the corresponding connection 36 and is not offset, other corresponding lateral surface portions 20, which are located on the same side as that of the non-offsetting lateral surface portion 20 in the wave continuation direction X, are not offset. Specifically, in FIG. 7, among the lateral surface portions 20 that are aligned in the wave continuation direction X with the non-offsetting lateral surface portion 20, which is joined to the top surface portion 21 directly connected to the corresponding connection 36, four lateral surface portions 20, which are located on the left side of the non-offsetting lateral surface portion 20, which is joined to the top surface portion 21 directly connected to the corresponding connection 36, are not offset. In FIG. 7, each portion, which is located in a dotted ellipse, indicates these lateral surface portions 20, which are not offset.

As discussed above, when all of the lateral surface portions (the non-offsetting lateral surface portions) 20, which are located on the one side (the left side in the wave continuation direction X in FIG. 7) of the top surface portion 21 directly connected to the corresponding connection 36, are not offset, the width of the adjacent lower top surface portion 21, which is adjacent to and is located on the left side of the top surface portion 21 directly connected to the corresponding connection 36, can be set to the same width (i.e., P/2) as that of the other top surface portions 21.

Each of these five non-offsetting lateral surface portions 20 is flush with and is directly connected to its adjacent lateral surface portion 20, which is adjacent to the non-offsetting lateral surface portion 20 in the perpendicular direction Y. In each of the two columns (the two upwardly projecting ridges) C of the segments 22, which are located on the one side (the left side in the wave continuation direction X in FIG. 7) of the column of the segments 22 connected to the corresponding connections 36, three lateral surface portions 20, which are arranged one after another in the perpendicular direction Y and have a length 2A, a length A and a length 2A, respectively, are sequentially offset in the wave continuation direction X to form the three segments 22 having these lateral surface portions 20, respectively. In each of the other two columns (the two upwardly projecting ridges) C of the segments 22, which are located on the other side (the right side in the wave continuation direction X in FIG. 7) of the column C of the segments 22 connected to the connections 36, five lateral surface portions 20, which are arranged one after another in the perpendicular direction Y and respectively have the length A, are sequentially offset in the wave continuation direction X to form the five segments 22 having these lateral surface portions 20, respectively.

Next, the upper punches 151 and the lower punches 152, which are used in the offset fin forming device 150 of the second embodiment, will be described with reference to FIG. 8. In FIG. 8, similar to FIG. 5 of the first embodiment, for descriptive purposes, only two of the upper punches 151 and only three of the lower punches 152, and a processing state of the planar plate portion 34, which is processed with these punches 151, 152, are depicted, and the depiction of the remaining punches 151, 152 is omitted for the sake of simplicity.

Figure 8:
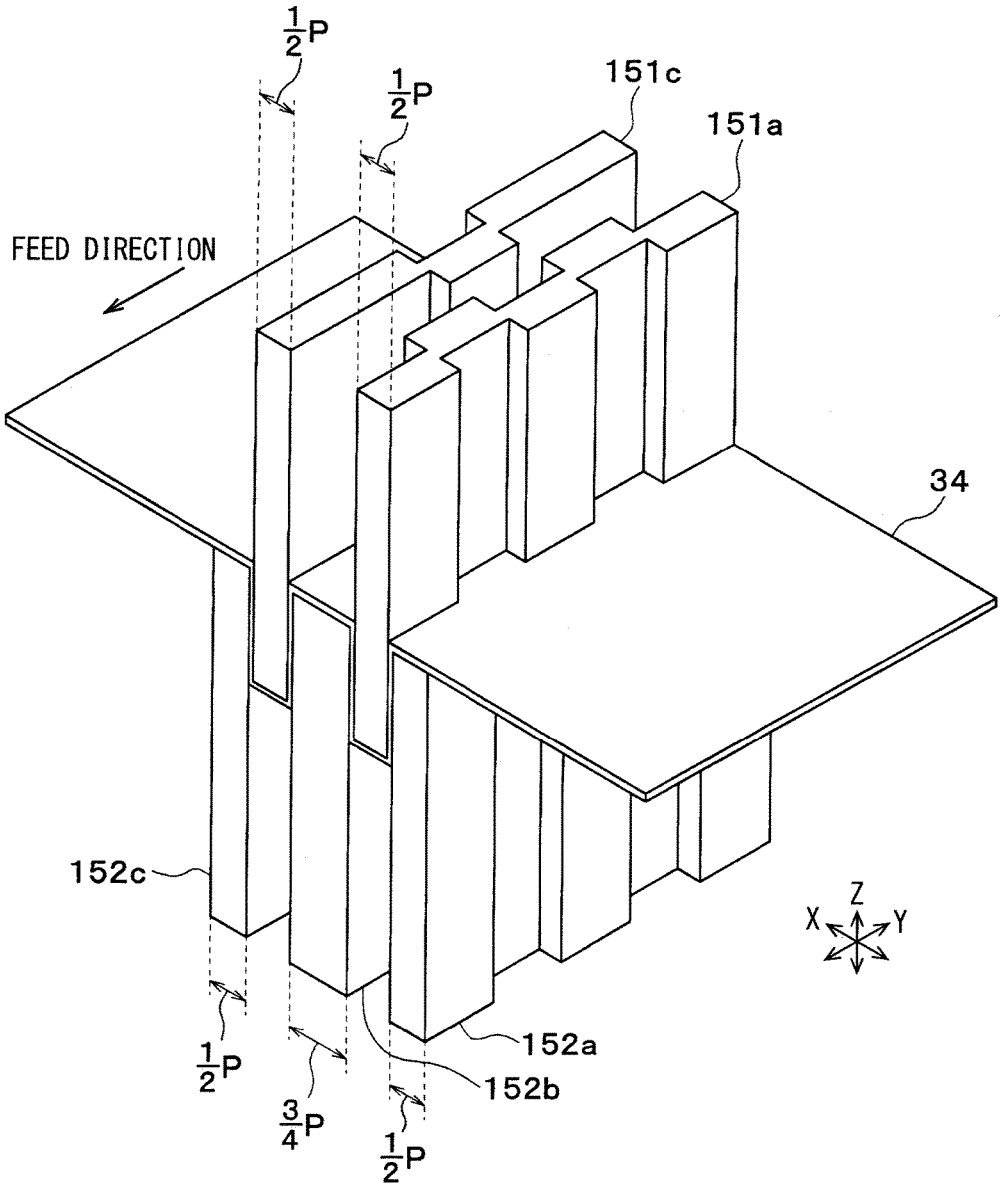
FIG. 8 is a perspective view showing punches of an offset fin forming device according to the second embodiment of the present disclosure.

As shown in FIG. 8, each of the upper punches 151 and the lower punches 152 has a corresponding cross section that is shaped to correspond with the shapes of the corresponding top surface portions 21 of the second embodiment. As discussed above, in the second embodiment, the lateral surface portions 20, which are located on the one side (the left side in the wave continuation direction X in FIG. 7) of the top surface portion 21 directly connected to the corresponding connection 36, are not offset. Because of the above reason, in the second embodiment, a tertiary upper punch 151*c* and a tertiary lower punch 152*c*, which form the non-offsetting lateral surface portions 20, are provided.

According to the second embodiment, in addition to the advantages similar to those of the first embodiment, the required strength of the planar plate portion 34 can be ensured in the offset fin forming step. Specifically, in the offset fin 10 of the first embodiment shown in FIG. 1, the adjacent top surface portion 21, which is adjacent to and is located on the left side of the top surface portion 21 directly connected to the corresponding connection 36, has the width (i.e., P/4 measured in the wave continuation direction X) that is smaller than the width (i.e., P/2 measured in the wave continuation direction X) of the other top surface portions 21. Therefore, there is a possibility of that the required strength of the planar plate portion 34 cannot be ensured at the time of processing the strip plate 30 with the punches 151, 152.

In contrast, in the second embodiment, all of the five lateral surface portions 20, which are located on the one side (the left side in the wave continuation direction X in FIG. 7) of the top surface portion 21 directly connected to the corresponding connection 36, are not offset, so that the width of the adjacent top surface portion 21, which is adjacent to and is located on the left side of the top surface portion 21 directly connected to the corresponding connection 36, can be set to the same width (i.e., P/2) as that of the other top surface portions 21. As a result, the required strength of the planar plate portion 34 can be ensured in the offset fin forming step.

Third Embodiment

Next, a third embodiment of the present disclosure will be described with reference to FIGS. 9 and 10. In the third embodiment, similar portions, which are similar to those of the first and/or second embodiment(s), will not be described redundantly, and only different portions, which are different from the first and second embodiments, will be described.

Figure 9:
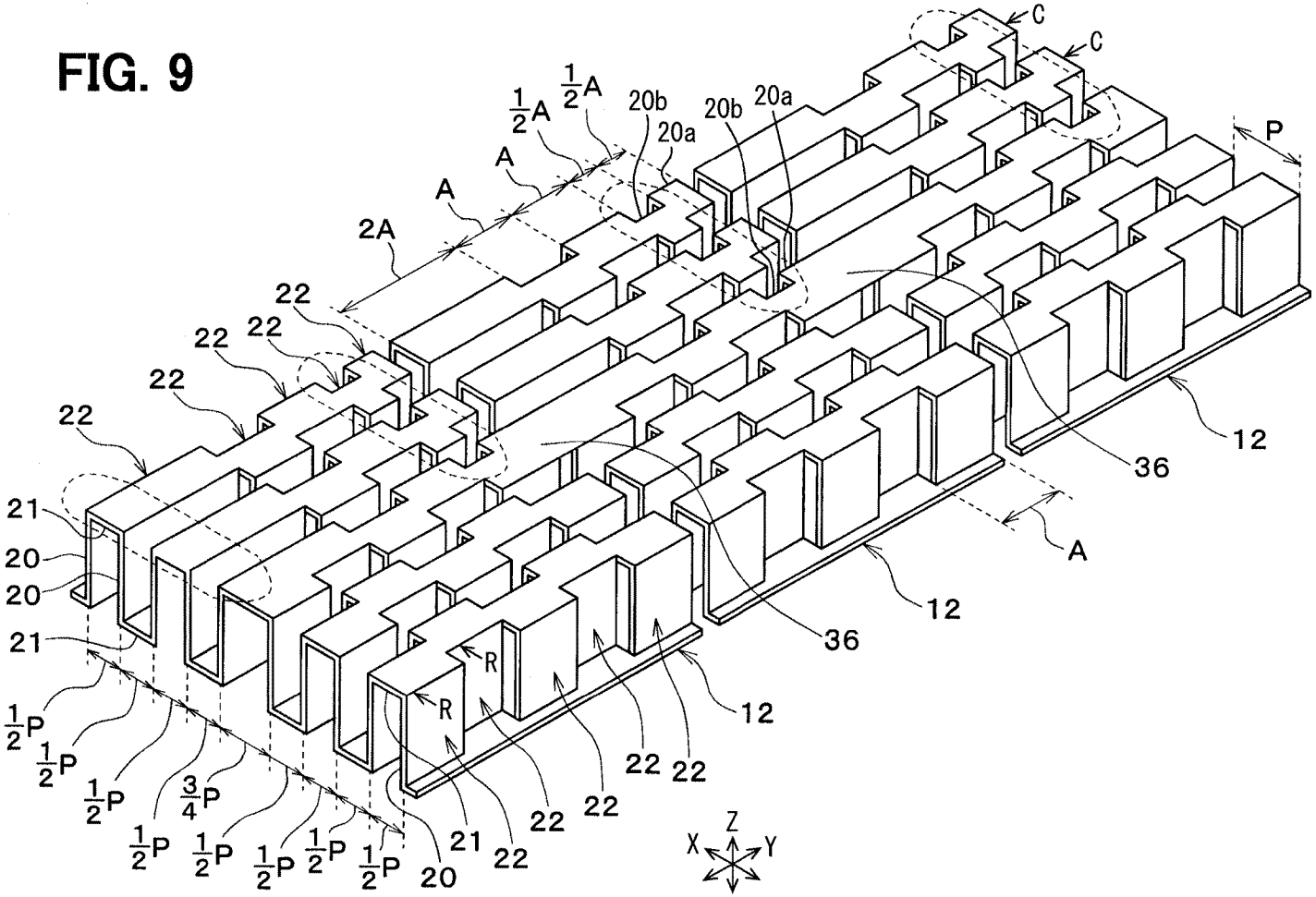
FIG. 9 is a perspective view showing offset fins according to a third embodiment of the present disclosure.

As shown in FIG. 9, in an offset fin 12 of the third embodiment, one (the left one in the wave continuation direction X in FIG. 9) of the two lateral surface portions 20 joined to the top surface portion 21 directly connected to the corresponding connection 36 includes a non-offsetting lateral surface portion 20*a* and an offsetting lateral surface portion 20*b*, and this offsetting lateral surface portion 20*b* is offset and has a short length A/2 (i.e., one half of the predetermined length A), which is smaller than the predetermined length A. Furthermore, among the lateral surface portions 20 that are aligned in the wave continuation direction X with the one (the left one in the wave continuation direction X) of the two lateral surface portions 20 joined to the top surface portion 21 directly connected to the corresponding connection 36 in FIG. 7 of the second embodiment, each of four lateral surface portions 20, which are located on the left side of the one of the two lateral surface portions 20 joined to the top surface portion 21 directly connected to the corresponding connection 36 in FIG. 7 of the second embodiment, now includes a non-offsetting lateral surface portion 20*a* and an offsetting lateral surface portion 20*b* in FIG. 9 of the third embodiment, and this offsetting lateral surface portion 20*b* is offset and has the short length A/2 (i.e., one half of the predetermined length A), which is smaller than the predetermined length A.

Specifically, in the third embodiment, with respect to adjacent two top surface portions 21, which are respectively located on one side and the other side of the corresponding connection 36 in the perpendicular direction Y, all of the lateral surface portions 20 located on one side (the left side in the wave continuation direction X in FIG. 9) of one of the adjacent two top surface portions 21, which is located on the one side (the right side in the perpendicular direction Y in FIG. 9) of the corresponding connection 36, are not offset. In contrast, all of the lateral surface portions 20 located on the one side (the left side in the wave continuation direction X in FIG. 9) of the other one of the adjacent two top surface portions 21, which is located on the other side (the left side in the perpendicular direction Y in FIG. 9) of the corresponding connection 36, are offset to respectively form the non-offsetting lateral surface portion 20*a* and the offsetting lateral surface portion 20*b* that respectively have the short length A/2 (i.e., one half of the predetermined length A). In FIG. 9, each portion, which is located within a dotted ellipse, indicates the corresponding offsetting lateral surface portions 20*b*, which are offset and respectively have the short length A/2.

In each of the two columns (the two upwardly projecting ridges) C of the segments 22 located on the one side (the left side in the wave continuation direction X in FIG. 9) of the column (serving as a predetermined column) C of the segments 22 connected to the connections 36 in the offset fin 12 of the third embodiment, five lateral surface portions 20 (including the non-offsetting lateral surface portion 20*a* and the offsetting lateral surface portion 20*b*), which are arranged one after another in the perpendicular direction Y, are offset one after another and have the length 2A, the length A, the length A, the length A/2 and the length A/2, respectively, to form the five segments 22 having these lateral surface portions 20 (including the non-offsetting lateral surface portion 20*a* and the offsetting lateral surface portion 20*b*). These two columns (the two upwardly projecting ridges) C serve as first side columns of the present disclosure. In contrast, in each of the other two columns (the other two upwardly projecting ridges) C of the segments 22, which are located on the other side (the right side in the wave continuation direction X in FIG. 9) of the column C of the segments 22 connected to the connections 36 in the offset fin 12 of the third embodiment, five lateral surface portions 20, which are arranged one after another in the perpendicular direction Y and respectively have the length A, are sequentially offset in the wave continuation direction X to form the five segments 22 having these lateral surface portions 20. These other two columns (the other two upwardly projecting ridges) C serve as second side columns of the present disclosure. Thereby, in the offset fin 12 of the third embodiment, the number of the segments 22 in each of the columns C of the segments 22 located on the one side of the column C of the segments 22 connected to the connections 36, is identical to the number of the segments 22 in each of the columns C of the segments 22 located on the other side of the column C of the segments 22 connected to the connections 36.

Next, the upper punches 151 and the lower punches 152, which are used in the offset fin forming device 150 of the third embodiment, will be described with reference to FIG. 10. In FIG. 10, similar to FIGS. 5 and 8 of the first and second embodiments, for descriptive purposes, only two of the upper punches 151 and only three of the lower punches 152, and a processing state of the planar plate portion 34, which is processed with these punches 151, 152, are depicted, and the depiction of the remaining punches 151, 152 is omitted for the sake of simplicity.

Figure 10:
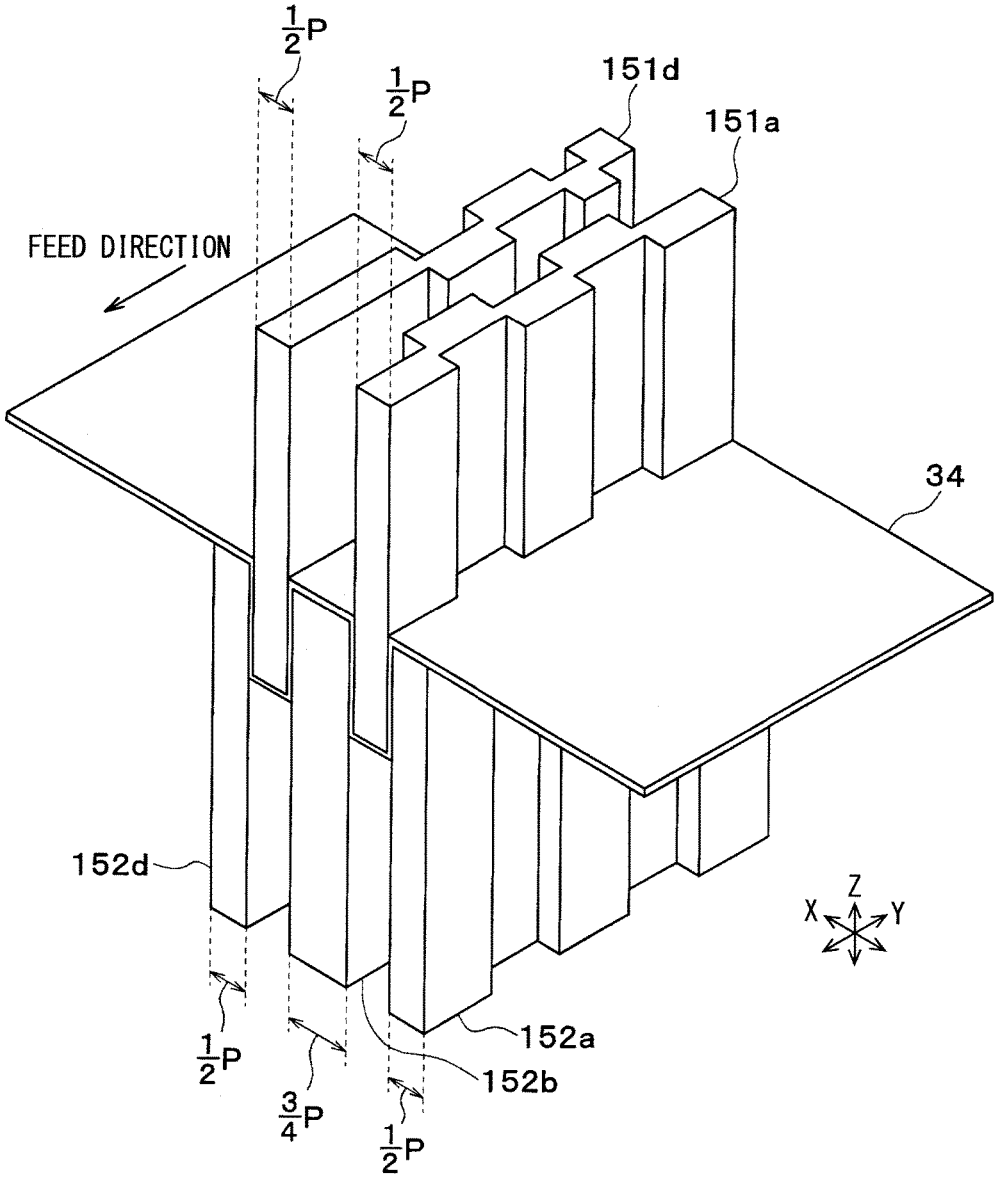
FIG. 10 is a perspective view showing punches of an offset fin forming device according to the third embodiment.

As shown in FIG. 10, each of the upper punches 151 and the lower punches 152 has a corresponding cross section that is shaped to correspond with the shapes of the corresponding top surface portions 21 of the third embodiment. As discussed above, according to the third embodiment, each of the lateral surface portions 20, which are located on the one side (the left side in the wave continuation direction X in FIG. 9) of the top surface portion 21 directly connected to the corresponding connection 36, includes the non-offsetting lateral surface portion 20*a* and the offsetting lateral surface portion 20*b*, and this offsetting lateral surface portion 20*b* is offset from the non-offsetting lateral surface portion 20*a* in the wave continuation direction X and has the length A/2, which is smaller than the predetermined length A. Because of the above reason, in the third embodiment, a quaternary upper punch 151*d* and a quaternary lower punch 152*d*, which form the non-offsetting lateral surface portion 20*a* and the offsetting lateral surface portion 20*b*, are provided.

According to the third embodiment, the provision of the offsetting lateral surface portions 20*b* having the short length A/2, which is smaller than the predetermined length A, enables the above-described structure, in which the number of the segments 22 in each of the columns C of the segments 22 located on the one side of the column C of the segments 22 connected to the connections 36, is identical to the number of the segments 22 in each of the columns C of the segments 22 located on the other side of the column C of the segments 22 connected to the connections 36. In this way, in addition to the advantages similar to those of the second embodiment, it is possible to minimize the deterioration of the heat exchange performance of the offset fin 12.

Other Embodiments

The present disclosure is not limited to the above embodiments, and the above embodiments may be modified as follows without departing from the principle of the present disclosure. Furthermore, it is possible to have any combination of the features (the devices or means) of the above embodiments within the principle of the present disclosure.

For example, in each of the above embodiments, the three offset fins 10, 11, 12 are connected one after another as the single unit by the two connections 36. However, the present disclosure is not limited to this configuration. For example, two offset fins 10, 11, 12 may be connected one after another as a single unit by one connection 36. Alternatively, four or more offset fins 10, 11, 12 may be connected one after another as a single unit by three or more connections 36.

Furthermore, in each of the above embodiments, the connections 36 are formed at the widthwise center (i.e., the center in the wave continuation direction X) of the strip plate 30. However, the present disclosure is not limited to this one. For example, the connections 36 may be formed at any widthwise location, which is other than the widthwise center, in the strip plate 30.

What is claimed is:

1. An offset fin manufacturing method for manufacturing offset fins, in each of which lateral surface portions and top surface portions are alternately and continuously formed to have a cross section in a rectangular waveform along a wave continuation direction of the rectangular waveform in each of rows, which are arranged one after another in a perpendicular direction that is perpendicular to the wave continuation direction, while each corresponding lateral surface portion among all of the lateral surface portions of the rows are alternately offset in the wave continuation direction at every predetermined length along the perpendicular direction, and thereby segments are formed by the lateral surface portions and the top surface portions of the rows in the offset fin, the offset fin manufacturing method comprising:

a feeding step of feeding a strip plate;

a connection forming step of forming a connection in the strip plate at every predetermined interval in a feed direction of the strip plate;

an offset fin forming step of bending a planar plate portion located between corresponding two of the connections in the strip plate to form each of the offset fins such that two of the top surface portions, which are located at an upstream end and a downstream end, respectively, of the offset fin in the feed direction of the strip plate, are respectively and directly connected to the corresponding two of the connections; and a cutting step of cutting a corresponding one of the connections at every predetermined number of the offset fins, which are connected one after another by the connections, wherein:

the offset fin forming step includes forming each of the offset fins such that:

two of the lateral surface portions are joined to a corresponding one of the two of the top surface portions, which are respectively and directly connected to the corresponding two of the connections, in a corresponding one of the rows, and one of the two of the lateral surface portions joined to the corresponding one of the two of the top surface portions is not offset in the wave continuation direction, and thereby a length of the corresponding one of the two of the top surface portions measured along the wave continuation direction is increased in comparison to at least another one of the top surface portions in the corresponding one of the rows;

the lateral surface portions, which are other than the two of the lateral surface portions joined to the corresponding one of the two of the top surface portions and are overlapped with the two of the lateral surface portions in a view taken in the wave continuation direction, at least one of the lateral surface portions is located on the same side as that of the one of the two of the lateral surface portions with respect to the corresponding one of the two of the top surface portions and is not offset in the wave continuation direction;

the one of the two of the lateral surface portions includes a non-offsetting lateral surface portion, which is not offset in the wave continuation direction, and an offsetting lateral surface portion, which is offset in the wave continuation direction and has a length that is measured in the perpendicular direction and is smaller than the predetermined length; and the at least one of the lateral surface portions, which is located on the same side as that of the one of the two of the lateral surface portions and is not offset in the wave continuation direction, includes a non-offsetting lateral surface portion, which is not offset in the wave continuation direction, and an offsetting lateral surface portion, which is offset in the wave continuation direction and has a length that is measured in the perpendicular direction and is smaller than the predetermined length, to correspond with the non-offsetting lateral surface portion and the offsetting lateral surface portion, respectively, of the one of the two of the lateral surface portions.

2. The offset fin manufacturing method according to claim 1, wherein the offset fin forming step includes forming each of the offset fins such that:

the segments are arranged to form columns, which are arranged one after another in the wave continuation direction, and the top surface portions of corresponding ones of the segments are joined one after another in the perpendicular direction in each of the columns;

the columns include:

a predetermined column that includes the two of the top surface portions, which are respectively and directly connected to the corresponding two of the connections;

at least one first side column, which is located on a first side of the predetermined column in the wave continuation direction; and at least one second side column, which is located on a second side of the predetermined column in the wave continuation direction, while the second side is opposite from the first side in the wave continuation direction; and the number of the corresponding ones of the segments located in the at least one first side column is equal to the number of the corresponding ones of the segments located in the at least one second side column.

3. An offset fin manufacturing method for manufacturing offset fins, in each of which lateral surface portions and top surface portions are alternately and continuously formed to have a cross section in a rectangular waveform along a wave continuation direction of the rectangular waveform in each of rows, which are arranged one after another in a crossing direction that crosses the wave continuation direction, while each corresponding lateral surface portion among all of the lateral surface portions of the rows are alternately offset in the wave continuation direction at every predetermined length along the crossing direction, and thereby segments are formed by the lateral surface portions and the top surface portions of the rows in the offset fin, the offset fin manufacturing method comprising:

a feeding step of feeding a strip plate;

a connection forming step of forming a connection in the strip plate at every predetermined interval in a feed direction of the strip plate; and an offset fin forming step of bending a planar plate portion located between corresponding two of the connections in the strip plate to form each of the offset fins such that two of the top surface portions, which are located at an upstream end and a downstream end, respectively, of the offset fin in the feed direction of the strip plate, are respectively and directly connected to the corresponding two of the connections, wherein:

the offset fin forming step includes forming each of the offset fins such that:

two of the lateral surface portions are joined to a corresponding one of the two of the top surface portions, which are respectively and directly connected to the corresponding two of the connections, in a corresponding one of the rows, and one of the two of the lateral surface portions joined to the corresponding one of the two of the top surface portions is not offset in the wave continuation direction, and thereby a length of the corresponding one of the two of the top surface portions measured along the wave continuation direction is increased in comparison to at least another one of the top surface portions in the corresponding one of the rows;

the lateral surface portions, which are other than the two of the lateral surface portions joined to the corresponding one of the two of the top surface portions and are overlapped with the two of the lateral surface portions in a view taken in the wave continuation direction, at least one of the lateral surface portions is located on the same side as that of the one of the two of the lateral surface portions with respect to the corresponding one of the two of the top surface portions and is not offset in the wave continuation direction;

the one of the two of the lateral surface portions includes a non-offsetting lateral surface portion, which is not offset in the wave continuation direction, and an offsetting lateral surface portion, which is offset in the wave continuation direction and has a length that is measured in the crossing direction and is smaller than the predetermined length; and the at least one of the lateral surface portions, which is located on the same side as that of the one of the two of the lateral surface portions and is not offset in the wave continuation direction, includes a non-offsetting lateral surface portion, which is not offset in the wave continuation direction, and an offsetting lateral surface portion, which is offset in the wave continuation direction and has a length that is measured in the crossing direction and is smaller than the predetermined length, to correspond with the non-offsetting lateral surface portion and the offsetting lateral surface portion, respectively, of the one of the two of the lateral surface portions.

4. An offset fin manufacturing apparatus for manufacturing offset fins, in each of which lateral surface portions and top surface portions are alternately and continuously formed to have a cross section in a rectangular waveform along a wave continuation direction of the rectangular waveform in each of rows, which are arranged one after another in a perpendicular direction that is perpendicular to the wave continuation direction, while each corresponding lateral surface portion among all of the lateral surface portions of the rows are alternately offset in the wave continuation direction at every predetermined length along the perpendicular direction, and thereby segments are formed by the lateral surface portions and the top surface portions of the rows in the offset fin, the offset fin manufacturing apparatus comprising:

a feeding device that feeds a strip plate;

a connection forming device that forms a connection in the strip plate at every predetermined interval in a feed direction of the strip plate;

an offset fin forming device that bends a planar plate portion located between corresponding two of the connections in the strip plate to form each of the offset fins such that two of the top surface portions, which are located at an upstream end and a downstream end, respectively, of the offset fin in the feed direction of the strip plate, are respectively and directly connected to the corresponding two of the connections; and a cutting device that cuts a corresponding one of the connections at every predetermined number of the offset fins, which are connected one after another by the connections, wherein:

the offset fin forming device forms each of the offset fins such that:

two of the lateral surface portions are joined to a corresponding one of the two of the top surface portions, which are respectively and directly connected to the corresponding two of the connections, in a corresponding one of the rows, and one of the two of the lateral surface portions joined to the corresponding one of the two of the top surface portions is not offset in the wave continuation direction, and thereby a length of the corresponding one of the two of the top surface portions measured along the wave continuation direction is increased in comparison to at least another one of the top surface portions in the corresponding one of the rows;

the lateral surface portions, which are other than the two of the lateral surface portions joined to the corresponding one of the two of the top surface portions and are overlapped with the two of the lateral surface portions in a view taken in the wave continuation direction, at least one of the lateral surface portions is located on the same side as that of the one of the two of the lateral surface portions with respect to the corresponding one of the two of the top surface portions and is not offset in the wave continuation direction;

the one of the two of the lateral surface portions includes a non-offsetting lateral surface portion, which is not offset in the wave continuation direction, and an offsetting lateral surface portion, which is offset in the wave continuation direction and has a length that is measured in the perpendicular direction and is smaller than the predetermined length; and the at least one of the lateral surface portions, which is located on the same side as that of the one of the two of the lateral surface portions and is not offset in the wave continuation direction, includes a non-offsetting lateral surface portion, which is not offset in the wave continuation direction, and an offsetting lateral surface portion, which is offset in the wave continuation direction and has a length that is measured in the perpendicular direction and is smaller than the predetermined length, to correspond with the non-offsetting lateral surface portion and the offsetting lateral surface portion, respectively, of the one of the two of the lateral surface portions.

5. The offset fin manufacturing apparatus according to claim 4, wherein the offset fin forming device forms each of the offset fins such that:

the segments are arranged to form columns, which are arranged one after another in the wave continuation direction, and the top surface portions of corresponding ones of the segments are joined one after another in the perpendicular direction in each of the columns;

the columns include:

a predetermined column that includes the two of the top surface portions, which are respectively and directly connected to the corresponding two of the connections;

at least one first side column, which is located on a first side of the predetermined column in the wave continuation direction; and at least one second side column, which is located on a second side of the predetermined column in the wave continuation direction, while the second side is opposite from the first side in the wave continuation direction; and the number of the corresponding ones of the segments located in the at least one first side column is equal to the number of the corresponding ones of the segments located in the at least one second side column.

* * * * *